US006374452B1

(12) United States Patent
Essex et al.

(10) Patent No.: US 6,374,452 B1
(45) Date of Patent: Apr. 23, 2002

(54) TOOL STORAGE DOOR FOR A FLOOR CARE APPLIANCE

(75) Inventors: John D. Essex, North Canton, OH (US); Gad Shaanan, Westmount (CA); Ivan Brousseau, Montreal (CA); Walter Francovich, Pierrefonds (CA); Luc Mion, Montreal (CA); Darwin T. McKnight, Louisville, OH (US)

(73) Assignee: The Hoover Company, North Canton, OH (US)

( * ) Notice: Subject to any disclaimer, the term of this patent is extended or adjusted under 35 U.S.C. 154(b) by 0 days.

(21) Appl. No.: 09/566,578

(22) Filed: May 8, 2000

(51) Int. Cl.[7] ..... A47L 9/00
(52) U.S. Cl. ..... 15/323; 15/327.2
(58) Field of Search ..... 15/323, 327.1, 15/327.2

(56) References Cited

U.S. PATENT DOCUMENTS

| | | | | | |
|---|---|---|---|---|---|
| 3,651,536 | A | * | 3/1972 | Bolzan et al. | 15/323 |
| 3,778,863 | A | | 12/1973 | Westergren et al. | |
| 4,360,947 | A | * | 11/1982 | DeCosa et al. | 15/323 |
| 4,554,700 | A | | 11/1985 | Lyman | |
| 4,739,535 | A | * | 4/1988 | Schuld et al. | 15/323 X |
| 4,761,850 | A | * | 8/1988 | Romeo et al. | 15/323 |
| D315,041 | S | | 2/1991 | Bradd | |
| 5,014,385 | A | * | 5/1991 | Bradd et al. | 15/323 |
| 5,233,722 | A | | 8/1993 | McKnight et al. | |
| 5,247,719 | A | | 9/1993 | Wareham et al. | |
| 5,604,953 | A | * | 2/1997 | Castewell et al. | 15/323 |
| 6,070,288 | A | * | 6/2000 | Luckyx et al. | 15/323 |

FOREIGN PATENT DOCUMENTS

| | | | |
|---|---|---|---|
| DE | 4414406 | A1 | 11/1995 |
| GB | 2320179 | A | 9/1997 |
| KR | 97032660 | A | 7/1997 |

OTHER PUBLICATIONS

Photocopy of photographs of Eureka Worldvac Canister Received Oct. 1995.

* cited by examiner

*Primary Examiner*—Chris K. Moore
(74) *Attorney, Agent, or Firm*—A. Burgess Lowe; Michael J. Corrigan

(57) ABSTRACT

A tool storage door for a floor care appliance encloses a tool storage compartment formed on the floor care appliance for storing various floor care accessory tools. The tool storage door receives and supports at least one of the accessory tools. A cutout area is formed in the tool storage door for providing direct and unobstructed visibility to the accessory tool and for allowing a portion of the accessory tool to extend therethrough. A recess which is substantially complementary to the shape of the accessory tool is formed in an underside of the tool storage door for receiving the accessory tool on the tool storage door. A pair of latching tabs extends downwardly from the underside of the tool storage door for releasably retaining the accessory tool within the recess.

15 Claims, 5 Drawing Sheets

TOOL STORAGE DOOR FOR A FLOOR CARE APPLIANCE

BACKGROUND OF THE INVENTION

1. Technical Field

The invention relates to floor care appliances. Particularly, the invention relates to tool storage for floor care appliances. Even more particularly, the invention relates to a tool storage door which encloses a tool storage compartment of a floor care appliance.

2. Background Information

It is well known to provide on-board tool storage on floor care appliances. On-board tool storage provides increased flexibility to various types of floor care appliances, such as upright vacuum cleaners, canister vacuum cleaners or upright extractors as having accessory tools stored on-board allows the floor care appliance to be easily changed between on-the-floor cleaning and above-the-floor cleaning. The accessory tools are typically stored within a tool storage compartment formed within a housing of the floor care appliance. For aesthetic purposes and to assist in preventing the tools from falling out of the storage compartment, a tool storage door is often used to enclose the tool storage compartment.

Although some tool storage doors are opaque, often tool storage doors are formed of a transparent material to provide visibility to the accessory tools both during use and at the point of sale of the floor care appliance. A transparent tool storage door allows the user to quickly identify the desired tool location when changing to and from above-the-floor cleaning. A transparent tool storage door also provides visibility to the accessory tools at the point-of-sale to inform the consumer as to what accessory tools are included with the purchase of the floor care appliance. Further, some accessory tools may add significant value to the floor care appliance or include graphics which inform the consumer as to specific features of the accessory tool. It would be advantageous to prominently display these accessory tools at the point of sale to assist the consumer in making a purchasing decision.

Although prior art tool storage doors are adequate for the purposes for which they are intended, these prior art tool storage doors do not effectively communicate to the consumer which accessory tools are included with the purchase of the floor care appliance or may not adequately display the features or graphics of the accessory tool. For example, opaque tool storage doors obstruct visibility into the tool storage compartment, thus requiring the consumer to open the tool storage door to determine what accessory tools are included with the floor care appliance. However, access to the floor cleaning appliance is not always available at the point of sale. Transparent tool storage doors are intended to alleviate this problem by providing visibility into the tool storage compartment however, it is possible that in some well lit retail stores a glare is produced on the transparent tool door making the contents of the tool storage compartment not readily apparent. Further, some tool storage doors are tinted for aesthetic purposes making it difficult to view the accessory tools stored within the tool storage compartment.

Thus, it would be desirable for a tool storage door to provide direct and unobstructed visibility to the accessory tools yet retain the accessory tools within the tool storage compartment. This direct and unobstructed visibility to the accessory tools not only would eliminate the effects of glare but also would allow the consumer to see any graphics or features of the accessory tools which may assist the consumer in making a purchasing decision.

Additionally, tool storage compartments typically include a fixed number of tool storage recesses for storing specific types of accessory tools. Adding an accessory tool to the floor care appliance would require substantial modifications to the floor care appliance body, which is both time consuming and expensive for the manufacturer. Thus, it would be desirable to provide a tool storage door which allows additional accessory tools to be added to the floor care appliance with minimal changes being required to the floor care appliance body.

Therefore, the need exists for a tool storage door which allows a floor care appliance accessory tool to be held within a tool storage compartment while still providing direct visibility to the tool during use and at the point-of-sale of the floor care appliance, and which allows an accessory tool to be added to the floor care appliance unit without substantial modifications to the appliance body.

SUMMARY OF THE INVENTION

Objectives of the invention include providing a new and improved tool storage door for a vacuum cleaner tool storage compartment.

A further objective is to provide a new and improved tool storage door which provides increased visibility to accessory tools stored within the tool storage compartment.

A still further objective is to provide a new and improved tool storage door which encloses the tool storage compartment and prevents inadvertent removal of the accessory tools.

These and other objectives will be readily apparent from the following description taken in conjunction with the accompanying drawings. In carrying out the invention in one form thereof, these objectives and advantages are obtained by providing

BRIEF DESCRIPTION OF THE DRAWINGS

The preferred embodiment of the invention, illustrative of the best mode in which applicants have contemplated applying the principals is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
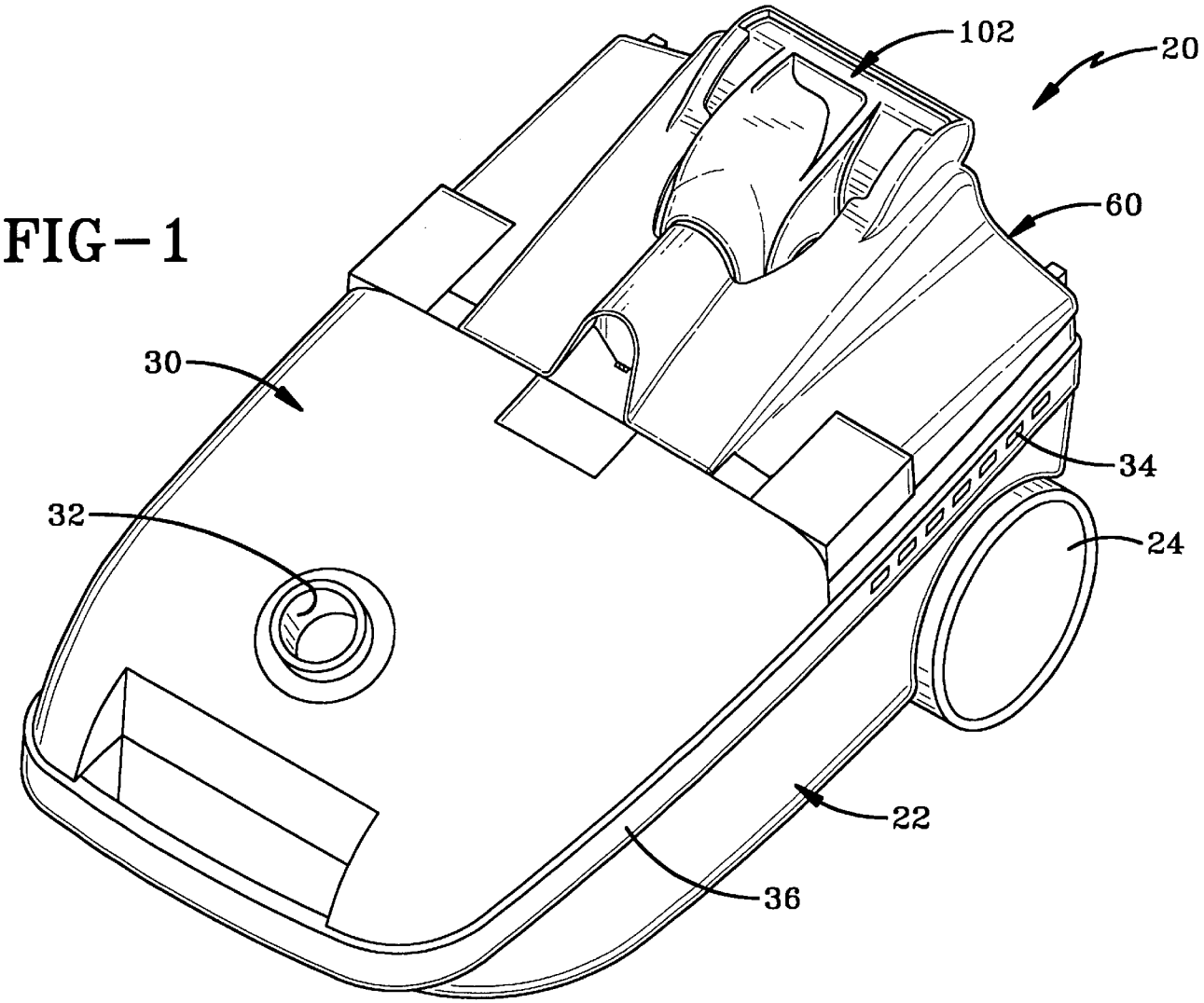
FIG. 1 is a perspective view of the tool storage door enclosing a tool storage compartment of a canister vacuum cleaner.

A floor care appliance in the form of a canister-type vacuum cleaner is shown in FIG. 1 and is indicated generally at 20. Although floor care appliance 20 is shown as a canister vacuum cleaner, it is understood that floor care appliance 20 could be any type of floor care appliance, such as an upright vacuum cleaner, an upright carpet extractor or a canister carpet extractor, having on-board tool storage. The vacuum cleaner 20 includes a canister body or housing 22 having a pair of rear wheels 24 and a single front wheel 26 (FIG. 7) for translating the vacuum cleaner across a floor surface during use. A lid 30 is hingedly attached to the canister body 22 for enclosing a vacuum cleaner filter bag (not shown). An inlet opening 32 is formed in the lid 30 for receiving a usual vacuum cleaner hose. During use of vacuum cleaner 20, a suction is created in the vacuum cleaner hose for removing dust and dirt during either on-the-floor cleaning or above-the-floor cleaner and produces a dirt-laden air stream therein. The hose conveys the dirt laden air stream to the filter bag where the dust and dirt is filtered from the air stream before the air stream is exhausted out a plurality of vent openings 34 formed in the canister body 22, and particularly formed in a furniture guard 36.

Figure 2:
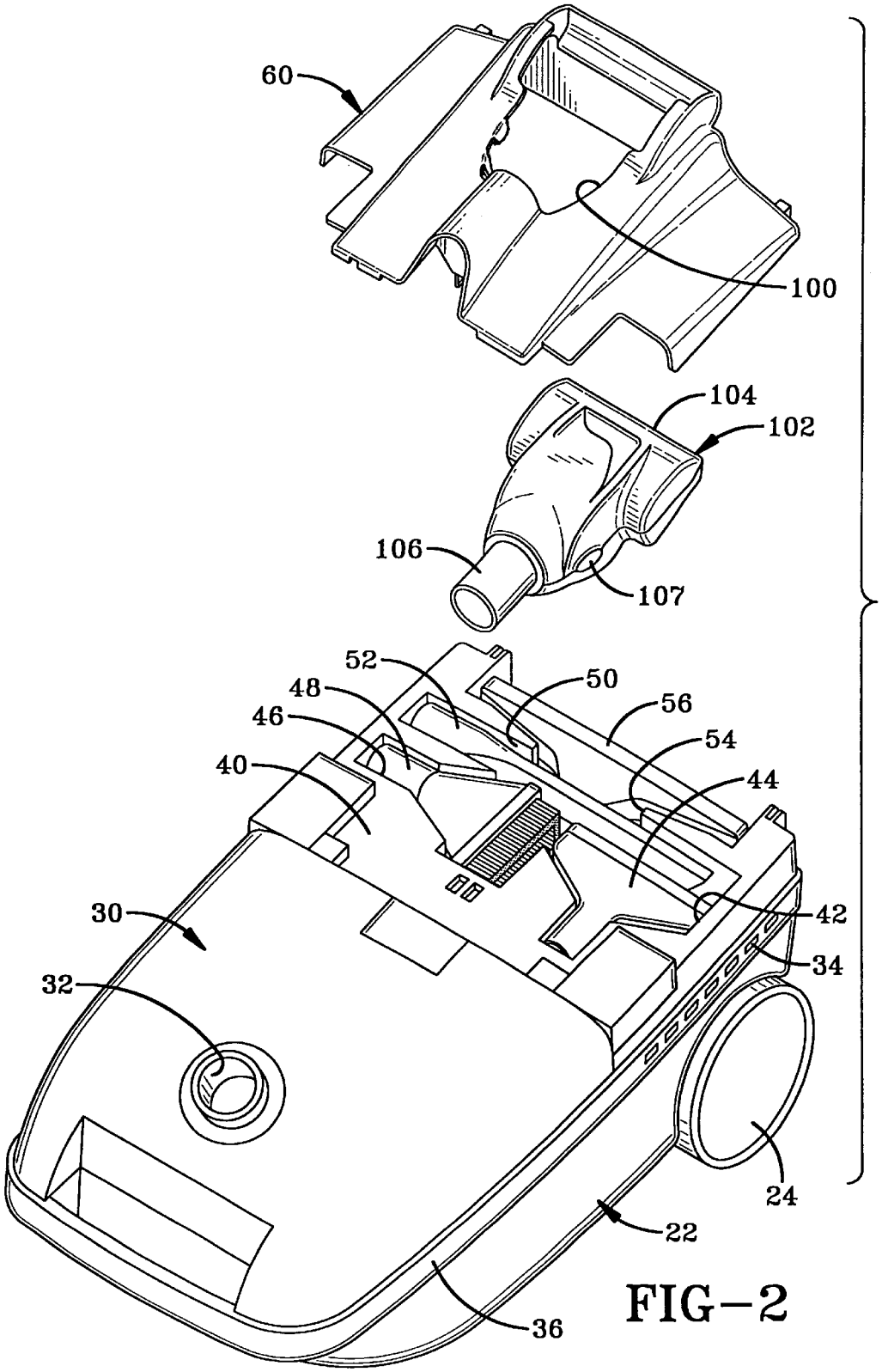
FIG. 2 is a perspective view of the canister vacuum cleaner of FIG. 1 showing the tool storage door and an accessory tool exploded therefrom.
Figure 3:
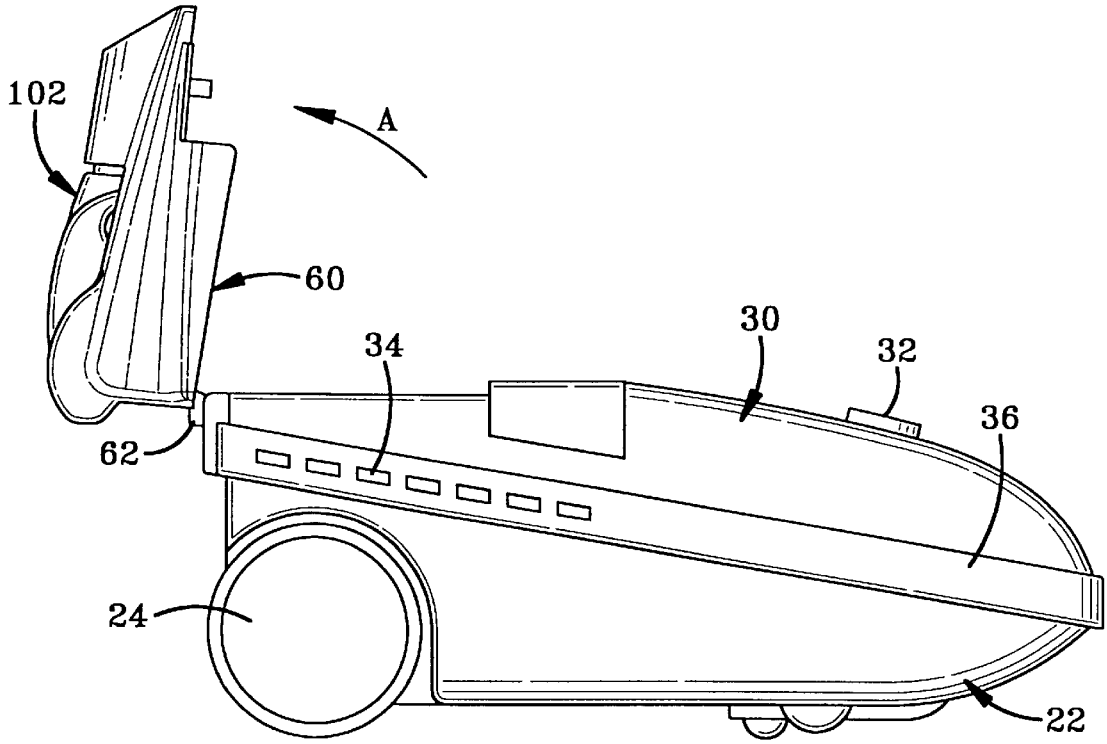
FIG. 3 is a side elevational view showing the tool storage door pivoted to an open position.
Figure 5:
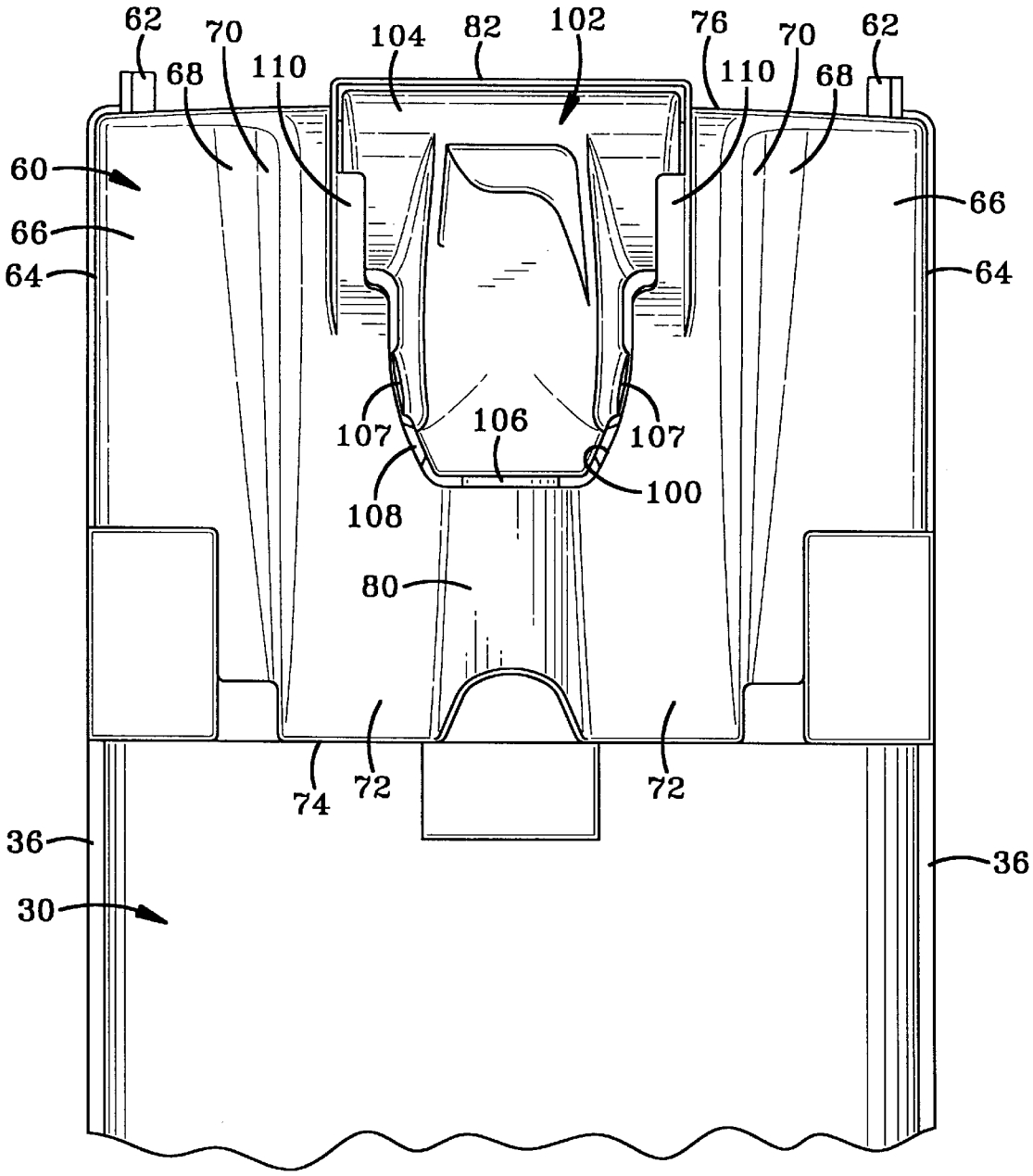
FIG. 5 is an enlarged top plan view showing the tool storage door enclosing the tool storage compartment.

Referring to FIG. 2, a storage compartment 40 which includes a plurality of recesses is formed in canister body 22 for receiving and storing various floor care appliance accessory tools. In particular, storage compartment 40 is formed with an upholstery nozzle recess 42 for receiving an upholstery tool 44, a dusting brush recess 46 for receiving a dusting brush 48, a crevice tool recess 50 for receiving a crevice tool 52, and a hard floor tool recess 54 for receiving a hard floor tool 56. As shown in FIGS. 1, 3 and 5, a tool storage door or cover 60 is pivotally mounted on canister body 22 and is pivotal between an open position (FIG. 3) and a closed position (FIG. 1). The tool storage door 60 encloses the storage compartment 40 and retains accessory tools 44, 48, 52 and 56 in their respective recesses during use and transportation of the vacuum cleaner 20. It is understood that tool storage door 60 may be molded of an opaque, transparent or tinted material without affecting the concept of the invention. As best seen in FIGS. 3 and 5, a pair of hinges 62 pivotally connect the tool storage door 60 to the canister body 22 allowing the tool storage door to pivot between the open and closed positions.

Figure 7:
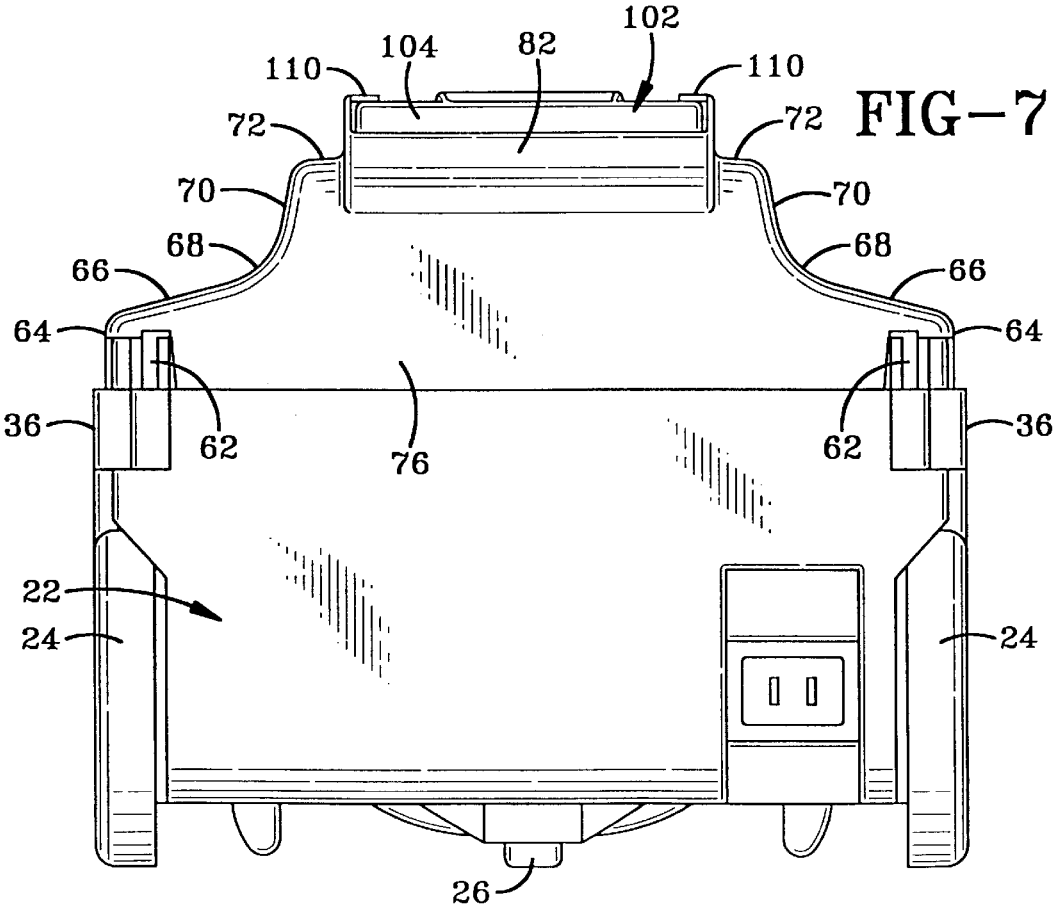
FIG. 7 is a rear elevational view of the tool storage door shown in a closed position on the canister cleaner.

Referring to FIG. 7, the tool storage door 60 includes symmetrical right and left sides and is contoured to form a pair of stepped surfaces 66 and 72. Each of the symmetrical sides of tool storage door 60 includes a pair of first side walls 64 which extend in a generally vertical direction to mate with and overlap the canister body when the tool storage door is in the closed position. Side walls 64 are curved inwardly at a top thereof to form bottom stepped surfaces 66. Bottom stepped surfaces 66 extend inwardly from their respective side walls 64 and slant upwardly towards an inner curved corner 68. Corners 68 curve upwardly into a pair of second side walls 70 which extend in a generally vertical direction. Side walls 70 are curved inwardly at the top thereof to form top stepped surfaces 72.

Figure 4:
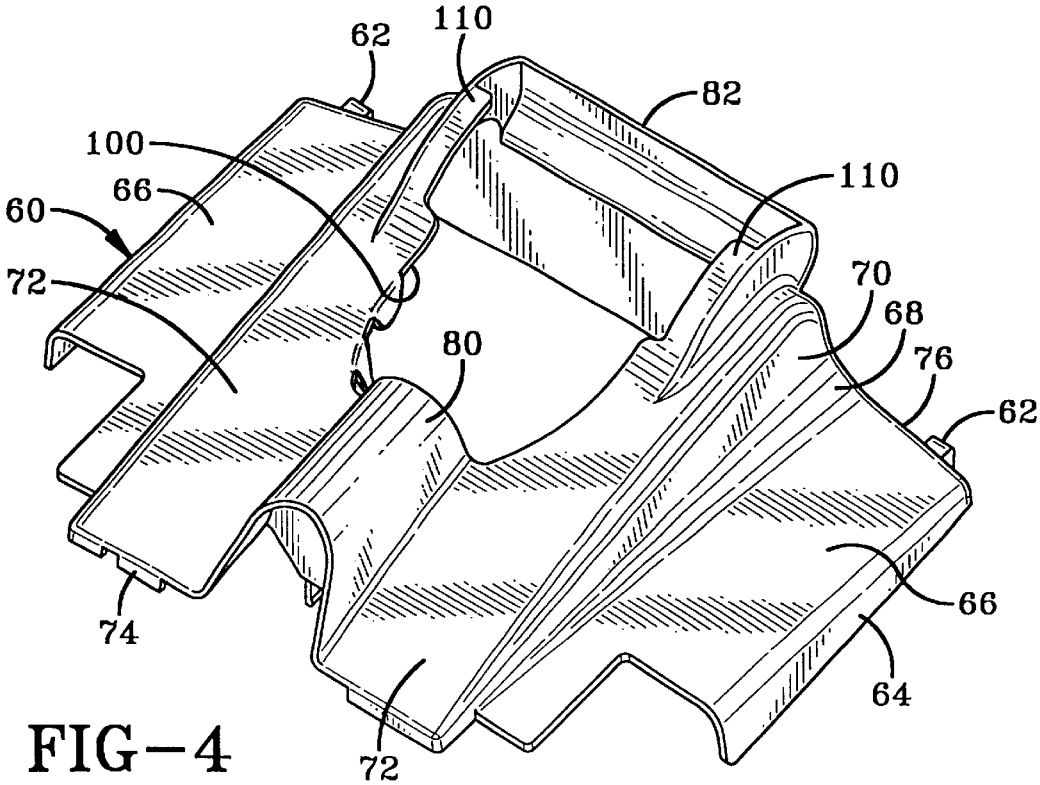
FIG. 4 is a perspective view of the tool storage door.
Figure 6:
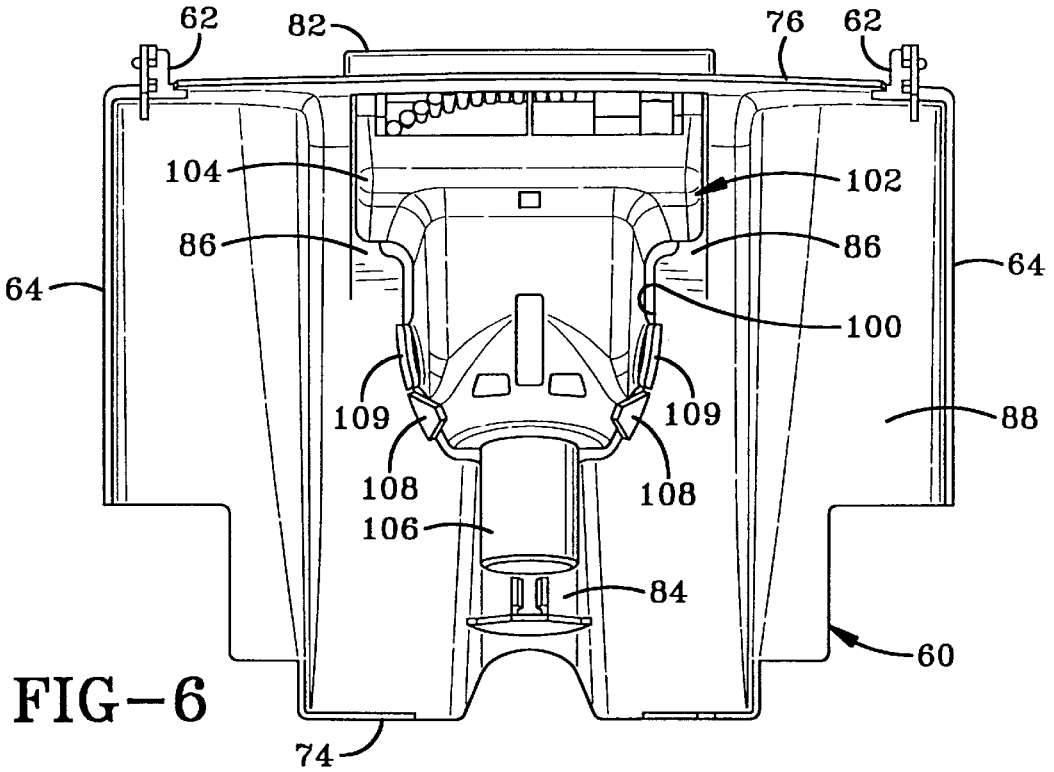
FIG. 6 is a bottom plan view of the tool storage door shown with the accessory tool held thereby.

Referring to FIGS. 4 and 5, tool storage door 60 includes a front edge 74 and a rear surface 76. An arcuate front protrusion 80 extends transversely across tool storage door 60 to connected the top stepped surfaces 72. A rear protrusion 82 extends upwardly from each of the top stepped surfaces 72, loops in a front-to-rear longitudinal direction and terminates into rear surface 76. The front protrusion 80 and the rear protrusion 82 form corresponding front and rear recesses 84 and 86 (FIG. 6), respectively, on a bottom surface or underside 88 of the tool storage door 60. As best seen in FIG. 4, bottom stepped surfaces 66 are slanted downwardly from front edge 74 to rear surface 76 of tool storage door 60 giving the first side walls 64 a triangular shape which converges in a front to rear direction. Top stepped surfaces 72 are slanted downwardly from the rear surface 76 to the front edge 74 of tool storage door 60 giving the second side walls 70 a triangular shape which converges in a rear to front direction.

In accordance with the invention and as best seen in FIGS. 2 and 4, a cutout area or opening 100 is formed in tool storage door 60 for receiving an accessory tool 102. Cutout area or opening 100 is formed in tool storage door 60 such that the peripheral edges of cutout area 100 are bounded by tool storage door 60. Accessory tool 102 is shown in FIGS. 1, 2, 5, 6 and 7 as a hand held turbine tool, however it is understood that accessory tool 102 could be any type of floor care accessory tool without affecting the concept of the invention. Accessory tool 102 is positioned within tool storage compartment 40 and includes a working portion or nozzle 104 at a front thereof and a tubular connection stem 106 at a rear thereof. A pair of release buttons 107 are formed on nozzle 104 which allow nozle 104 to be disassembled for cleaning and maintaining accessory tool 102. Connection stem 106 facilitates attachment of the accessory tool 102 to a hose. Front recess 84 formed by front protrusion 80 has a shape substantially complementary to the shape of tubular connection stem 106 of the accessory tool. Rear recess 86 formed by rear protrusion 82 has a shape substantially complementary to the shape of the nozzle 104. Recesses 84 and 86 receive respective portions 106 and 104 of the accessory tool 102 when the accessory tool is in the stored position of FIGS. 1, 5 and 6. A pair of latching tabs 108 (FIG. 6) extend downwardly from the underside 88 of tool storage door 60 to frictionally retain accessory tool 102 within the recesses. A pair of downwardly protruding ribs 109 extend from the underside 88 of the tool storage door. Ribs 109 prevent accidental depression of release buttons 107 and thus inadvertent opening of accessory tool 102 during removal of the accessory tool 102 from the tool storage door 60.

As shown in FIG. 5, cutout area 100 has a shape which is substantially complementary to the peripheral shape of the accessory tool 102. A pair of retaining walls 110 extend inwardly into cutout area 100 from each side of rear protrusion 82. Retaining walls 110 overlap a portion of nozzle 104 to retain the accessory tool within storage compartment 40 and prevent removal of the accessory tool when the tool storage door is in the closed position. As shown in FIG. 1, cutout area 100 allows the top surface of nozzle 104 to extend therethrough providing direct and unobstructed visibility to a portion of the accessory tool.

During use and at the point of sale of the floor care appliance, the tool storage door 60 is in the closed position with accessory tool 102 held thereby. The top surface of nozzle 104 extends through cutout area 100 providing direct and unobstructed visibility to the top portion of the accessory tool. Thus, any graphics or product features of accessory tool 102 are readily visible to a consumer at the point of sale. The substantially complementary shape of recesses 86 and 84 to the nozzle 104 and stem 106, respectively, gives accessory tool 102 and tool storage door 60 an integrated and aesthetically pleasing appearance to vacuum cleaner 20. Retaining walls 110 and front protrusion 80 cooperate with latching tabs 108 to hold the accessory tool against the underside 88 of the tool storage door 60 and prevent access to or removal of the accessory tool when the tool storage door is in the closed position. The accessory tool 102 is accessed by pivoting the tool storage door to the open position, as shown by arrow A of FIG. 3. An outward force is applied to the accessory tool for removal thereof from the tool storage compartment 40.

In addition to providing direct and unobstructed visibility to the accessory tool while the accessory tool is stored within tool storage compartment 40, tool storage door 60 allows an accessory tool to be added to a floor care appliance requiring minimal changes to the appliance housing. Many tool storage compartments include tool receiving recesses formed therein, such as recesses 42, 46, 50 and 54 of floor care appliance 20. To add another accessory tool to floor care appliance 20 would require substantial modifications to canister body 22 which are both time consuming and expensive to the floor care appliance manufacturer. Tool storage door 60 allows an accessory tool, such as accessory tool 102, to be added to and stored on-board a floor care appliance without substantial modification to the canister body 22.

Accordingly, the improved tool storage door for a floor care appliance is simplified, provides an effective, inexpensive, and efficient device which achieves all of the enumerated objectives. While there has been shown and described herein several embodiments of the present invention, it should be readily apparent to persons skilled in the art that numerous modifications may be made therein without departing from the true spirit and scope of the invention. Accordingly, it is intended by the appended claims to cover all modifications which come within the spirit and scope of the invention.

What is claimed is:

1. A floor care appliance, including:

a housing formed with a tool storage compartment;

an accessory tool removably stored within the tool storage compartment;

a tool door attached to the housing for enclosing the tool storage compartment, said tool door being formed with a cutout area which provides direct visibility to at least a portion of the accessory tool while said accessory tool is stored within the tool storage compartment; and a latch for releasably securing the accessory tool within the recessed area of the tool door.

2. The floor care appliance defined in claim 1 wherein part of the accessory tool extends through the cutout area when said accessory tool is stored within the tool storage compartment.

3. The floor care appliance defined in claim 1 wherein the tool door is formed with a recessed area for receiving the accessory tool.

4. The floor care appliance defined in claim 3 wherein the recessed area is substantially complementary in shape to part of the accessory tool.

5. The floor care appliance defined in claim 4 wherein the accessory tool attaches to an underside of the tool door; wherein the tool door includes a retaining wall; and wherein said retaining wall overlaps the accessory tool to retain said accessory tool within the recessed area of the tool door.

6. A floor care appliance including:

a housing;

a tool storage compartment formed in said housing;

an accessory tool stored within said tool storage compartment, said accessory tool having a peripheral shape; and a tool storage door formed with a recessed area for receiving the accessory tool and for enclosing the tool storage compartment, said tool storage door being formed with a cutout which allows a portion of the accessory tool to extend through said tool storage door, said cutout having peripheral edges bounded by said tool storage door and having a shape which is substantially complementary to the peripheral shape of the accessory tool.

7. The floor care appliance defined in claim 6 wherein the recessed area is substantially complementary in shape to part of the accessory tool.

8. The floor care appliance defined in claim 7 wherein the accessory tool attaches to an underside of the tool door.

9. The floor care appliance defined in claim 8 wherein the tool door includes a retaining wall and wherein said retaining wall overlaps the accessory tool to retain said accessory tool within the recessed area of the tool door.

10. The floor care appliance defined in claim 9 further including a latch for releasably securing the accessory tool within the recessed area of the tool door.

11. A floor care appliance, including:

a housing formed with a tool storage compartment;

an accessory tool removably stored within the tool storage compartment;

a tool door attached to the housing for enclosing the tool storage compartment, said tool door being formed with:

a cutout area which provides direct visibility to at least a portion of the accessory tool while said accessory tool is stored within the tool storage compartment, said cutout area having peripheral edges bounded by said tool door;

a recessed area for receiving the accessory tool; and a latch for releasably securing the accessory tool within the recessed area of the tool door.

12. The floor care appliance defined in claim 11 wherein part of the accessory tool extends through the cutout area when said accessory tool is stored within the tool storage compartment.

13. The floor care appliance defined in claim 12 wherein the recessed area is substantially complementary in shape to part of the accessory tool.

14. The floor care appliance defined in claim 13 wherein the accessory tool attaches to an underside of the tool door.

15. The floor care appliance defined in claim 14 wherein the tool door includes a retaining wall and wherein said retaining wall overlaps the accessory tool to retain said accessory tool within the recessed area of the tool door.

* * * * *